US006231269B1

(12) United States Patent
Shear et al.

(10) Patent No.: US 6,231,269 B1
(45) Date of Patent: May 15, 2001

(54) APPARATUS FOR RELEASING A RACK CHOCK OF A JACK-UP RIG

(75) Inventors: Morris Shear, Metairie; Paul Geiger, Sr., New Orleans, both of LA (US)

(73) Assignee: Friede & Goldman, Ltd., Houston, TX (US)

( * ) Notice: Subject to any disclaimer, the term of this patent is extended or adjusted under 35 U.S.C. 154(b) by 0 days.

(21) Appl. No.: 09/263,893

(22) Filed: Mar. 5, 1999

(51) Int. Cl.[7] ..... E02B 17/06
(52) U.S. Cl. ..... 405/198; 254/97
(58) Field of Search ..... 405/196–198; 254/95, 97, 112, 89 R; 74/89.14, 89.15

(56) References Cited

U.S. PATENT DOCUMENTS

Re. 32,589 * 2/1988 Goldman et al. ..... 405/198
3,343,371 * 9/1967 Heitkamp ..... 405/198
4,662,787 * 5/1987 Tatsuguchi ..... 405/198
4,813,814 * 3/1989 Shibuta et al. ..... 405/198
5,921,714 * 7/1999 Goldman ..... 405/198
5,943,919 * 8/1999 Babinski ..... 74/89.14 X
6,030,149 * 2/2000 Foo et al. ..... 405/198 X

* cited by examiner

*Primary Examiner*—David Bagnell
*Assistant Examiner*—Sunil Singh
(74) *Attorney, Agent, or Firm*—Keaty Professional Law Corporation

(57) ABSTRACT

A "frozen" rack chock of a jack-up rig is released by a moving force imparted on the rack chock by a worm gear assembly. The worm gear assembly has a tooth wheel with a plurality of teeth and a worm gear member provided with a worm thread that engages the teeth for transmitting rotational force from a drive motor to the tooth wheel. A shaft of the tooth wheel is operationally connected to the rack chock to cause disengagement of the rack chock from the contact surface of a leg chord when the tooth wheel is rotated.

28 Claims, 5 Drawing Sheets

APPARATUS FOR RELEASING A RACK CHOCK OF A JACK-UP RIG

BACKGROUND OF THE INVENTION

The present invention relates to an offshore rig suitable for conducting mineral exploration and production operations, and more particularly to a self-elevating jack-up rig incorporating a releasing mechanism for a rack chock.

Jack-up rigs have been extensively used as the types of offshore working platforms especially suitable for deployment in medium water depth. Generally, this type of rig uses jackable legs for supporting a working platform, or hull at an elevated position in a selected location. When a jack-up rig is towed to a desired location, the legs extend upwardly through wells in the hull so as not to interfere with the towing. Once the rig is delivered to the selected location, the legs are lowered to the bottom of an ocean, and powerful jacks elevate the hull to an operating level above the waves.

The hull and the legs are rigidly engaged with each other through a system of rack teeth on the supporting legs and opposed, matching rack sections of rack chocks. The rack chocks are moved horizontally and vertically to allow a mating alignment with the leg chords. When the alignment is completed, the rack chock rigidly connects the hull to the legs of the rig. During operation of the rig, the legs and the hull remain locked in their unitary connection, resisting overturning moments imposed on the legs by wave forces.

When the legs and the hull are rigidly engaged, considerable pressures act on the surfaces of the meshed teeth of the leg chords and the rack chocks. In effect, the teeth become locked, and withdrawal of the rack chock from engagement with a leg chord becomes extremely difficult.

Still, under certain circumstances, such when repositioning the hull or the entire rig, the engagement between the legs and the hull must be broken. Oftentimes, conventional methods and equipment cannot generate sufficient force to release a "frozen" jack.

Heretofore, various methods have been employed for releasing of a screw jack. One of the conventional methods involves burning of the jack bearing plate or cap in order to break the rigid engagement between a leg chord and a rack chock. This method is labor-intensive, time-consuming and relatively expensive. Additionally, the cap must be replaced before the screw jack is moved laterally into an engagement with the leg teeth to reinstate the rigid engagement of the hull to the legs.

Other known techniques involve the use of a wedge-shaped device, wherein an inclined surface of the wedge facilitates release of the chock mechanism. This design is disclosed in U.S. Pat. Nos. 5,486,069 and 5,611,645 issued to John O. Breeden. Both patents disclose a fixation system that uses a toothed chord chock, which moves both horizontally and vertically. The toothed rack chock has upper and lower inclined surfaces. The fixation system includes an upper and lower wedge, which rides on upper and lower fixed inclined surfaces. The upper and lower wedges move to engage the upper and lower inclined surfaces of the rack chock and release the engagement between the leg chord and the rack chock. While such design can work satisfactory in many cases, there exists a need for a more straightforward design for releasing of a rack chock.

The present invention contemplates elimination of drawbacks associated with prior designs and provision of an improved mechanism for releasing of a rack chock from its rigid engagement with a leg chord.

SUMMARY OF THE INVENTION

It is, therefore, an object of the present invention to provide a jack-up rig with a rack chock releasing mechanism.

It is another object of the present invention to provide a rack chock releasing mechanism, which prevents locking of the rack chock in relation to a leg chord.

It is a further object of the present invention to provide an improved jack-up rig assembly, wherein the danger of a frozen rack chock is eliminated.

These and other objects of the present invention are achieved through a provision of a worm gear assembly operationally connected to a frame that carries a rack chock of a jack-up rig. The worm gear assembly comprises a tooth wheel with plurality of teeth disposed about a circumference of at least a portion of the tooth wheel and a worm gear member. The teeth have inwardly concave upper surface. The tooth wheel has a hollow body mounted on a shaft that is operationally connected to the rack chock.

The worm gear member is provided with a worm thread about a middle portion thereof, the thread having a generally frustoconical configuration. The worm gear member has a central shaft connected to a drive motor, and when the thread is engaged with the teeth of the tooth wheel rotational force is transmitted from the drive motor to the tooth wheel shaft.

By causing rotation of the tooth wheel, a moving force is imparted on the rack chock to facilitate positioning of the rack in engagement with a contact surface of the leg chord and disengagement therefrom when the tooth wheel is rotated in an opposite direction.

BRIEF DESCRIPTION OF THE DRAWINGS

Reference will now be made to the drawings, wherein like parts are designated by like numerals, and wherein.

DETAIL DESCRIPTION OF THE PREFERRED EMBODIMENT

Turning now to the drawings in more detail, numeral 10 designates a jack-up rig shown schematically in an elevated position. A hull 12 is supported by a plurality of legs 14 above a waterline 16. The legs 14 rest on the ocean floor (not shown), supporting the hull and working operations conducted from the hull decks.

Figure 1:
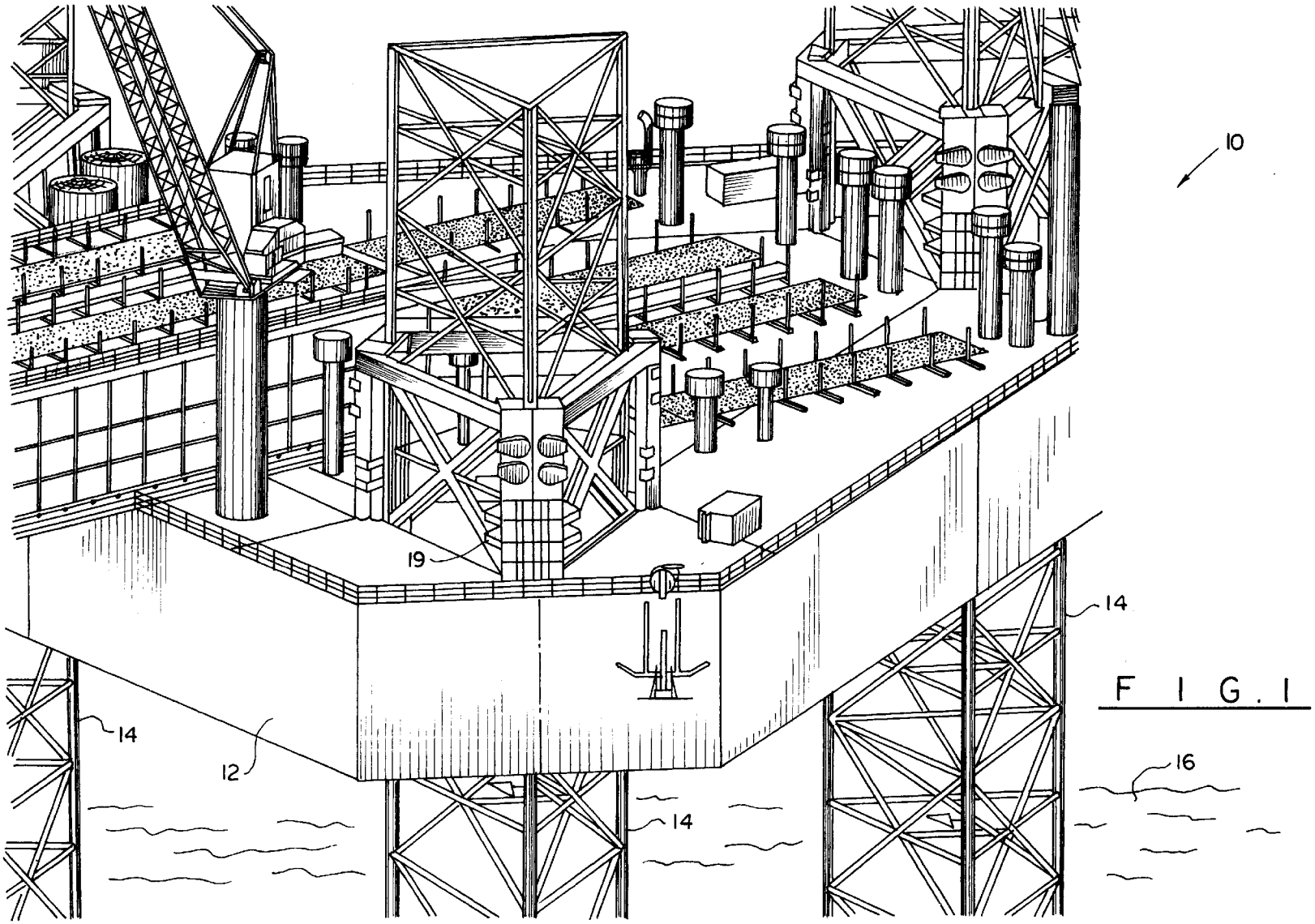
FIG. 1 is a perspective view of a jack-up rig of the present invention.

Each leg 14 has a plurality of leg chords 18, each of which is provided with a chord rack 20 having a series of horizontally extending teeth 22. Raising and lowering of the legs is performed with the help of a jacking system that is located above rack chock assemblies 19 (FIG. 1). Conventional leg jacking systems use driving pinions operationally connected to jacks. Jacking systems use jack pinions for engagement with opposite teeth of each leg chord rack 20.

After the rig 10 has been delivered to the pre-selected location and the legs have been lowered into the bottom of a body of water, the hull 12 is elevated. To retain the hull in its elevated position above the wave motions, the rack chock assemblies 19 must be moved into engagement with the leg chord rack 20.

Figure 2:
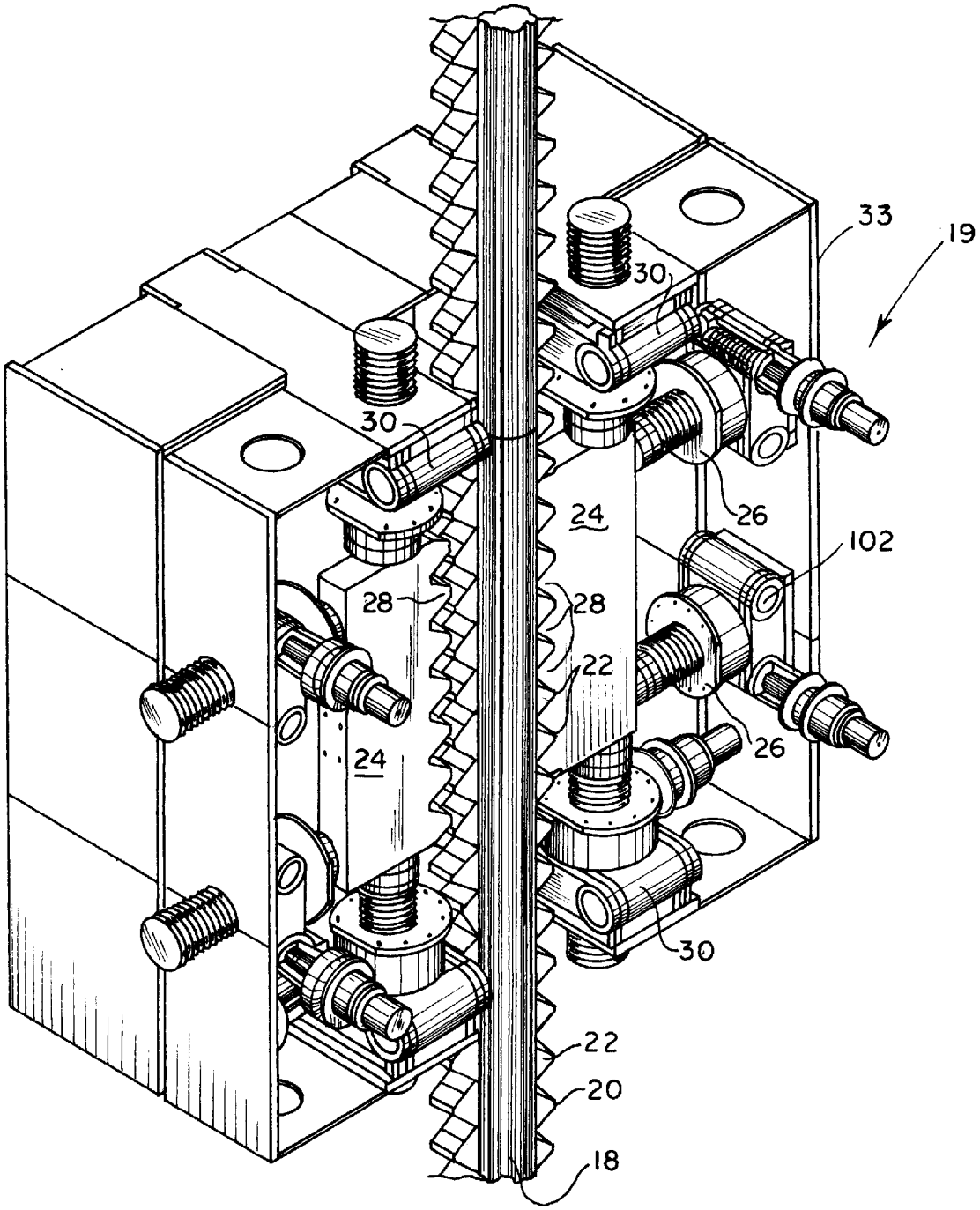
FIG. 2 is a detail view showing a rack chock engaged with a leg chord.

With reference to FIG. 2, the present invention comprises a rack chock assembly 19 for engaging and disengaging teeth 22 of the leg chord leg 20 with the teeth of the rack chock assembly. Each rack chock assembly 19 has a plurality of horizontally extending teeth 28 adapted for engagement with the teeth 22 of the leg chord rack 20. It is preferred that the teeth 22 and 28 have a matching profile, so as to provide a better contact between the meshed teeth.

The rack chocks assemblies 19 are supported by the hull 12 and move in and out of engagement with the chord racks 20 through a system of horizontal driving pinions, or jack screw assemblies 26. Typically, there are four horizontal jack screw assemblies 26 per each leg chord rack 20.

A plurality, typically four, vertical jack screw assemblies 30 are provided for each leg chord to allow vertical adjustment of the rack chock position in relation to the leg chord rack 20. Both horizontal jack screw assemblies 26 and vertical jack screw assemblies are enclosed in a housing 33, which moves both vertically and horizontally along with the jack screw assemblies 26 and 30, moving the rack chock assembly 19 in and out of engagement with a contact surface of the teeth 22 of the leg chord rack 20.

Figure 3:
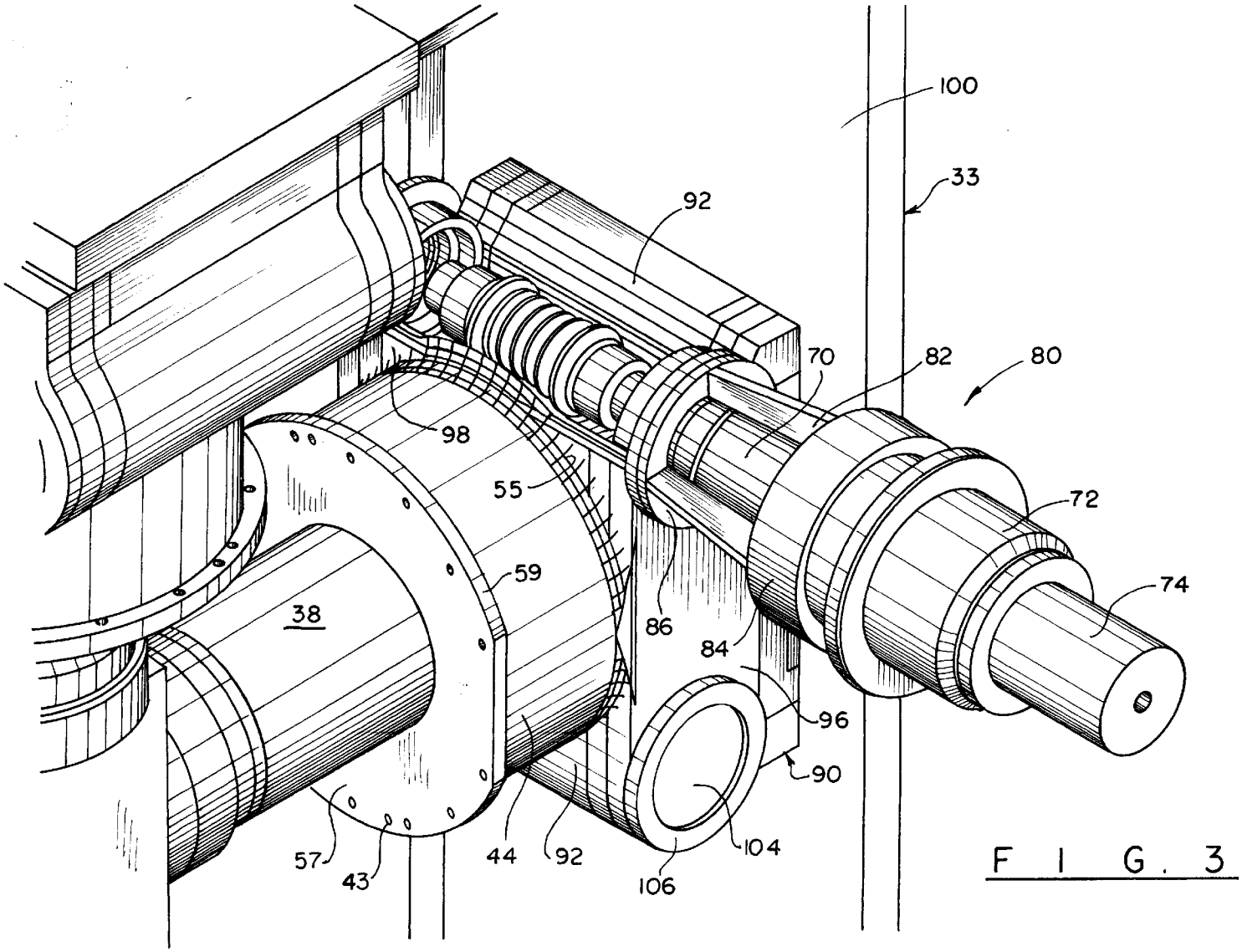
FIG. 3 is a detail view showing a two-part worm gear release mechanism in accordance with the present invention connected to a hydraulic motor.
Figure 4:
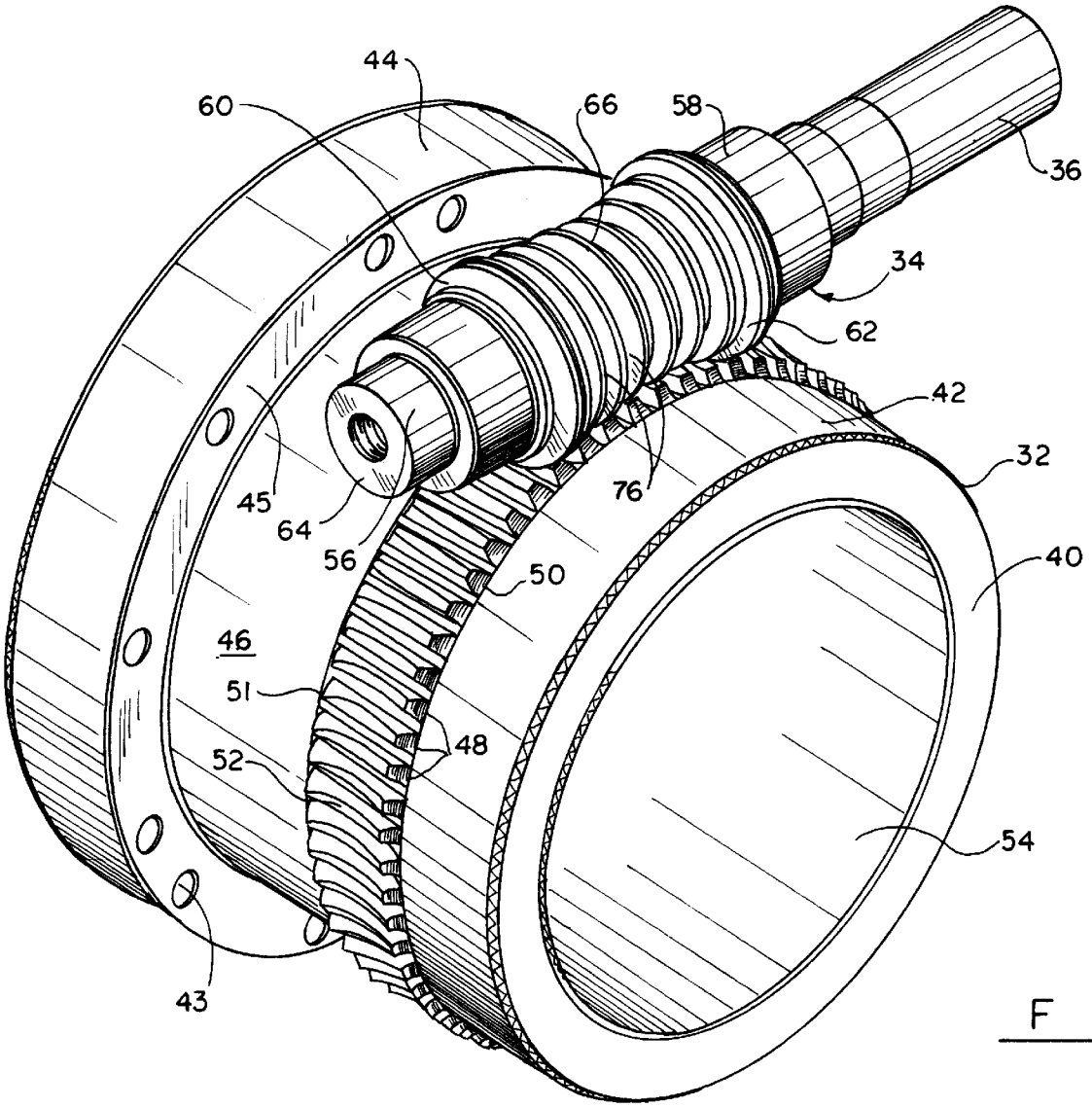
FIG. 4 is a detail view of the release mechanism, with the operational worm gear release mechanism engaged for rotation.

With reference to FIGS. 3 and 4, each jack screw assembly 26 and 30 comprises a worm gear unit, or worm gear assembly 80, having a tooth wheel 32 and a worm gear member 34. The worm gear units 80 are mounted in the housing 33 that protects the rotating engaging portions of the jack screw assemblies 26 and 30.

Each worm gear unit 80 ensures a positive motion of the rack chock assembly 19 through rotation of the worm gear member 34 and the tooth wheel 32. When the tooth wheel 32 and the worm gear member 34 are engaged, rotation from a power source is transmitted to the worm gear member 34 to the wheel 32 and then translating to a linear movement of the chock 24, as will be described in more detail below. The longitudinal axes of the central shaft 36 of the worm gear member 34 and the central shaft 38 of the wheel 32 are oriented at a right angle to each other.

The tooth wheel 32 comprises a hollow body 40 having a first cylindrical portion 42, a second cylindrical portion 44 and a middle cylindrical portion 46. A plurality of parallel teeth 48 are formed on the exterior circumference of the middle portion 46, extending to a line 50 on the first portion 42 and extending to a line 51 that separates the first cylindrical portion 42 and the middle portion 46.

Each tooth 48 has an inwardly concave contact surface 52 for engagement with the mating surface of the worm gear, as will be described in more detail hereinafter. A central opening 54 formed in the tooth wheel 32 receives the rotating shaft 38. A flange 45 connects the middle portion 46 with an enlarged diameter portion 44. A symmetrical flange 57 is fixedly attached to the outer circumferential edge 59 of the second portion 44 (see, FIG. 3). The attachment of the flanges 55 and 57 can be accomplished with the use of bolts 43, or in other suitable manner well known to those skilled in the art.

As can be seen in FIGS. 3 and 4, the worm gear member 34 comprises an elongated body having a pair of cylindrical portions 56 and 58, a pair of bevel portions 60, 62, a reduced diameter attachment portion 64 and a central portion 66. The central portion has a reduced diameter middle part and larger diameter outer parts.

A drive shaft 36 is attached to a motor adapter 70, which, in turn, is secured with a gear reducer 72. The gear reducer is operationally connected to a power means 74, which can be a hydraulic motor, or any other suitable power means. The motor 74 imparts rotational movement on the worm gear member 34 and transmits torque to the tooth wheel 32.

As can be more clearly seen in FIG. 3, each worm gear unit 80 is provided with splines 82 that are positioned between a flange 84 of the motor adapter 70 and a collar 86 encircling an opening in the worm gear holder, as will be explained in more detail below. The splines 82 can be two or more in number; they are designed to provide extra structural strength to the unit with rotating shafts extended in series, from the motor 74 to the worm gear member 34. These shafts extend in coaxial relationship to each other and are operationally connected for transmitting the rotational force.

The worm gear unit 80 further comprises a worm gear holder 90 (FIG. 3), which is formed as a box-like hollow body defined by an outer wall 92, an inner wall 94, a front plate 96 and a rear wall 98. The inner wall 94 is fixedly attached, such as by welding, to an interior wall 100 of the housing 33. In this manner, the body 90 is supported by the walls of the housing 33 at a pre-determined distance from the chock 24.

The front wall 96 is provided with openings 102 and 104; opening 102 being surrounded by a collar 86, and opening 104 being surrounded by a collar 106. The openings 102 and 104 are adapted to alternatively receive the worm gear member 34 during engagement or disengagement of the chock 24 with the leg chord 18. The opening 102 may serve as a receiving position for the worm gear member 34 threaded with a right-hand thread, and opening 104 may serve as a receiving position for the worm gear member 34 threaded with a left-hand thread to allow rotation of the worm gear member, or worm screw 34 in an opposite direction.

The holders 90 are pre-cast with the right-hand and the left-hand threads. When installed in the unit 80, the operator would select which of the openings 102 or 104 the worm gear member is to occupy and install the worm gear member 34 in that opening. When changing direction of rotation of the worm gear member 34, the direction of rotation of the motor 74 is reversed, allowing disengagement of the chock 24 from the leg chord teeth 22.

Figure 5:
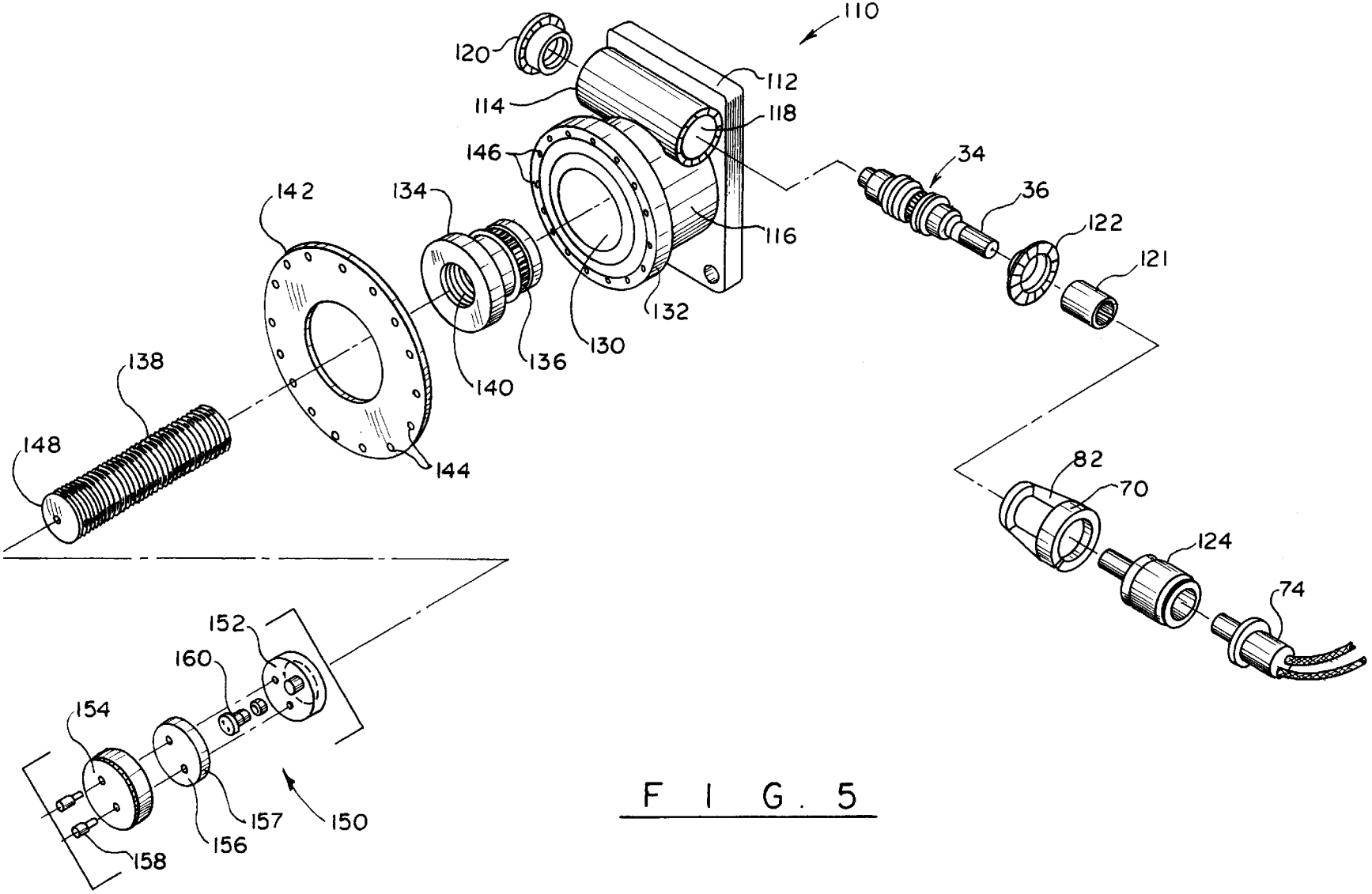
FIG. 5 is an exploded view illustrating another embodiment of a worm gear holder.

An alternative design of the worm gear holder is shown in FIG. 5. As can be seen in the drawings, the holder 110 comprises an attachment plate 112 adapted for fixed securing on the wall 100 of the housing 33. The holder 110 is provided with one sleeve 114 which receives the worm gear member, or worm screw 34 therein. The plate 112 also carries a tooth wheel cover 116. The longitudinal axes of the cover 116 and the sleeve 114 intersect at a right angle, and cutouts (not shown) in the contact surfaces of the sleeve 114 and the cover 116 allow engagement of the worm gear member 34 with the teeth of the wheel 32.

As can be further seen in the drawings, a central opening 118 in the sleeve 114 receives the worm gear member 34. The open ends of the sleeve 114 receive bearing houses 120, 122 therein. The bearing houses 120, 122 engage the shaft 36 of the worm screw 34 on opposite sides and facilitate rotation of the worm gear member in response to the torque transmitted from the motor 74.

A coupling 121 is fitted between the bearing house 122 and the motor adapter. The motor adapter 70, similar to the embodiment shown in FIG. 3, is engaged with the gear reducer 124, which, in turn, is operationally connected to the motor 74.

A central opening 130 in the cover 116 is surrounded by a flange 132. An internally threaded jack screw nut 134 is provided with teeth 136 formed on the exterior surface thereof. The teeth 136 match the threads on the worm screw 34 to impart rotation on the screw nut 134 when the worm gear member 34 is rotated. A jack screw 138 engages threads 140 formed on the interior wall of the jack screw nut 134 and rotates clockwise or counterclockwise depending on the direction of rotation of the worm gear member 34.

A cover plate 142 is mounted on an exterior side of the cover 116. The cover plate 142 is provided with a plurality of apertures 144 that are aligned with apertures 146 on the flange 132 and receive suitable securing means, for example bolts, engaging the cover plate 142 and the cover 116. Although not shown, the assembly 110 is positioned in a manner similar to the unit 80 within the housing 33 to provide connection and transmit linear movement to the jack screw 138.

An optional collapsible bearing assembly 150 may be interposed between the jack screw 138 and the chock 24. The collapsible bearing assembly 150 is provided with a bearing plate 152 which contacts an end 148 of the jack screw 138. A contact plate 154 is adapted for contacting a rack chock 24. A collapsible insert 156 is fitted between the contact plate 154 and the bearing plate 152. A collapsible removable medium 157 is sandwiched between the parallel plates that define the collapsible insert 156 to facilitate disengagement of the rack chock from the leg chord, when necessary. The contact plate 154 and the insert 156 are secured together and to the bearing plate 152 with the use of bolts 158, and the bearing plate 152 is secured to the jack screw 138 with a bolt 160. Of course, other securing means can be utilized, if desired.

Turning now in more detail to FIG. 4, the central portion 66 of the worm gear member 34 is machined to form worm threads 76, which facilitate transmission of power generated by the power means 74 to the tooth wheel 32 through engagement with the teeth 48. The threads 76 have frustoconical configurations with flat exterior surfaces, as shown in FIG. 4, that match the teeth 48 of the wheel 32.

The threads 76 have working depth and pitch diameter substantially similar to the depth and pitch of the teeth 48. The chordal thickness of the teeth 48 generally corresponds to the thickness of the worm threads 76. Circular pitch of the threads 76 is approximately equal to corresponding points on the circumference of the teeth 48. The clearance of the teeth 48 is generally the same as the distance between the top of the threads 76 and the bottom circumferential surface of the central portion 66. As a result, when the threads 76 are brought into engagement with the teeth 48, the threads 76 and the teeth 48 matingly engage with each other.

When rotation is imparted on the shaft 36, torque is transmitted to the tooth wheel 32. Since the shaft 38 of the tooth wheel 32 is operationally connected to a rack chock assembly 24, the latter is moved in and out of engagement with the leg chord teeth 22. Depending on the direction of rotation of the shaft 36, engagement and disengagement of the rack chock assembly 24 can be effected.

In the embodiment shown in FIGS. 2–4, each rack chock assembly 24 is provided with two horizontal and two vertical worm gear units 80 to allow precision positioning of the rack chock 24 in the horizontal and vertical planes in relation to the leg chord teeth 22. The design and structure of each unit 80 is similar to the design and structure described above. All moving and rotating parts of the releasing mechanism are enclosed in the housing 33, thereby preventing accidental injuries of the operator.

The worm gear assembly 30 can be used for releasing a locked rack chock. With the different diameter worm gear portions, the job of disengagement of the leg chord and the rack chock is substantially simplified. Additionally, less power is needed for moving the rack chock assembly out of engagement with the leg chord.

Many changes and modifications can be made in the design of the present invention without departing from the spirit thereof. We, therefore, pray that our rights to the present invention be limited only by the scope of the appended claims.

We claim:

1. An apparatus for releasing a rack chock pressed into engagement with a contact surface, comprising:

a worm gear assembly adapted for operational connection to said rack chock; and a means for imparting rotation to said worm gear assembly, said worm gear assembly translating said rotation into linear movements for exerting moving force on said rack chock, thereby moving said rack chock out of engagement with said contact surface, said movements having horizontal and vertical components.

2. The apparatus of claim 1, wherein said worm gear assembly comprises a tooth wheel and a worm gear member, said worm gear member transmitting rotation from said rotation imparting means to said tooth wheel by engaging teeth of said tooth wheel.

3. The apparatus of claim 2, wherein said tooth wheel comprises a generally cylindrical hollow body secured on a wheel shaft, said wheel shaft being adapted for engagement with said rack chock.

4. The apparatus of claim 3, wherein said worm gear member comprises a central driving shaft oriented at a substantially right angle to said wheel shaft.

5. The apparatus of claim 2, wherein said tooth wheel is provided with a plurality of teeth disposed about a circumference of said tooth wheel and said worm gear member is provided with worm threads for engaging said plurality of teeth, said worm gear member being operationally connected to said rotation imparting means.

6. The apparatus of claim 5, wherein each of said plurality of teeth has an inwardly concave middle portion.

7. The apparatus of claim 6, wherein said plurality of teeth are oriented in a substantially parallel relationship to a central axis of said tooth wheel.

8. The apparatus of claim 5, wherein said worm threads have a generally frustoconical configuration.

9. The apparatus of claim 2, wherein said rotation imparting means comprises a hydraulic motor connected to a gear reducer, said gear reducer being connected to a motor adapter secured co-axially with said worm gear member.

10. The apparatus of claim 2, wherein said worm gear member has a middle portion provided with worm threads, said middle portion having a reduced diameter central part disposed between larger diameter end parts.

11. The apparatus of claim 1, wherein said worm gear assembly comprises at least one horizontal worm gear unit for moving said rack chock along a horizontal plane, at least one vertical worm gear unit for moving said rack chock along a vertical plane and power means for transmitting moving force separately to said at least one horizontal worm gear unit and said at least one vertical worm gear unit.

12. The apparatus of claim 11, wherein said power means comprises a motor operationally connected to each worm gear unit.

13. The apparatus of claim 11, wherein each of said worm gear units comprises a tooth wheel mounted on a central shaft adapted for engagement with said rack chock, a worm gear member provided with worm threads for engaging teeth of said tooth wheel, said tooth wheel being internally threaded to allow engagement of the tooth wheel with a jack screw of said rack chock.

14. The apparatus of claim 13, wherein said worm gear assembly comprises an enclosure having an opening to allow extension of a central shaft of said worm gear member outwardly from said enclosure.

15. The apparatus of claim 14, wherein said power means comprises a gear reducer and a motor mounted co-axially with said gear reducer, said motor being operationally mounted to said gear reducer and said worm gear member.

16. An apparatus for releasing a rack chock pressed into engagement with a contact surface of a jack-up rig leg chord, comprising:

a worm gear assembly adapted for operational connection to said rack chock; and a means for imparting rotation to said worm gear assembly, said worm gear assembly translating said rotation into linear movements for exerting moving force on said rack chock, thereby moving said rack chock out of engagement with said contact surface, said movements having horizontal and vertical components, said worm gear assembly comprising at least one tooth wheel provided with a plurality of teeth about an exterior thereof and at least one worm gear member provided with worm threads, said plurality of teeth engaging said worm threads to impart a moving force on said rack chock and thereby cause disengagement of said rack chock from said contact surface of the leg chord when the worm gear assembly is rotated.

17. The apparatus of claim 16, wherein said at least one tooth wheel comprises a hollow body adapted for mounting on a jack screw of the rack chock, said at least one worm gear member comprises a central driving shaft operationally connected to a drive motor, and wherein said central driving shaft is adapted for orienting at a substantially right angle to the jack screw of the rack chock.

18. The apparatus of claim 16, wherein said plurality of teeth are inwardly concave and are disposed about a circumference over at least a portion of said at least one tooth wheel, and wherein said at least one worm gear member is provided with a reduced diameter central portion.

19. The apparatus of claim 16, wherein said worm gear assembly comprises at least one horizontal worm gear unit for moving said rack chock along a horizontal plane, at least one vertical worm gear unit for moving said rack chock along a vertical plane and wherein each of said worm gear units is provided with an independent power means for transmitting moving force separately to said at least one horizontal worm gear unit and said vertical worm gear unit.

20. The apparatus of claim 19, wherein said power means comprises a motor operationally connected to each worm gear unit.

21. The apparatus of claim 19, wherein each of said worm gear units comprises a worm gear member holder for receiving said worm gear member therein, said worm threads of the worm gear member being oriented in a pre-determined direction in relation to said plurality of teeth of the tooth wheel, said tooth wheel being formed with internal threads to allow engagement of the tooth wheel with a jack screw of the rack chock.

22. The apparatus of claim 21, wherein said worm gear member holder comprises an enclosure having an end plate with an opening to allow extension of a central shaft of said worm gear member outwardly from said enclosure, and wherein said power means is located outside of said enclosure.

23. The apparatus of claim 16, wherein said worm gear assembly comprises a pair of horizontal worm gear units and a pair of vertical gear units to allow precise positioning of said rack chock in relation to said leg chord of the jack-up rig.

24. The apparatus of claim 16, further comprising a collapsible bearing plate assembly mountable between the worm gear assembly and a rack chock body.

25. An apparatus for releasing a rack chock pressed into engagement with a contact surface of a jack-up rig leg chord, comprising:

a worm gear assembly adapted for operational connection to said rack chock, said worm gear assembly comprising at least one horizontal worm gear unit for moving said rack chock along a horizontal plane, at least one vertical worm gear unit for moving said rack chock along a vertical plane and wherein each of said worm gear units is provided with an independent power means for transmitting moving force separately to said at least one horizontal worm gear unit and said vertical worm gear unit; and a means for imparting rotation to each of said worm gear units, said worm gear units translating said rotation into linear movements for exerting moving force on said rack chock, thereby moving said rack chock out of engagement with said contact surface, each of said worm gear units comprising at least one tooth wheel provided with a plurality of teeth about an exterior thereof and at least one worm gear member provided with worm threads, said plurality of teeth engaging said worm threads to impart a moving force on said rack chock and thereby cause disengagement of said rack chock from said contact surface of the leg chord when the worm gear units are rotated.

26. The apparatus of claim 25, wherein said plurality of teeth are inwardly concave and are disposed about a circumference over at least a portion of said at least one tooth wheel, and wherein said at least one worm gear member is provided with a reduced diameter central portion disposed between enlarged diameter end portions.

27. The apparatus of claim 25, wherein said worm threads have a generally frustoconical configuration.

28. The apparatus of claim 25, wherein each of said worm gear units comprises a pair of horizontal worm gear units and a pair of vertical gear units to allow precise positioning of said rack chock in relation to said leg chord of the jack-up rig.

* * * * *